US007398720B2

(12) United States Patent
Fujiwara et al.

(10) Patent No.: US 7,398,720 B2
(45) Date of Patent: Jul. 15, 2008

(54) BLASTING METHOD

(75) Inventors: Shuzo Fujiwara, Tsukuba (JP); Takehiro Matsunaga, Tsukuba (JP); Ken Okada, Tsukuba (JP); Katsuo Kurose, Kobe (JP); Kenji Koide, Kobe (JP)

(73) Assignees: National Institute of Advanced Industrial Science and Technology, Tokyo (JP); Kabushiki Kaisha Kobe Seiko Sho, Hyogo (JP)

( * ) Notice: Subject to any disclaimer, the term of this patent is extended or adjusted under 35 U.S.C. 154(b) by 5 days.

(21) Appl. No.: 10/587,359

(22) PCT Filed: Mar. 22, 2005

(86) PCT No.: PCT/JP2005/005121

§ 371 (c)(1),
(2), (4) Date: Jul. 26, 2006

(87) PCT Pub. No.: WO2005/098347

PCT Pub. Date: Oct. 20, 2005

(65) Prior Publication Data

US 2007/0151437 A1 Jul. 5, 2007

(30) Foreign Application Priority Data

Mar. 31, 2004 (JP) ..... 2004-102763

(51) Int. Cl.
*F42B 33/00* (2006.01)
*F41H 5/16* (2006.01)

(52) U.S. Cl. ..... 86/50; 89/36.17

(58) Field of Classification Search ..... 89/36.17, 89/1.13; 86/50; 102/489
See application file for complete search history.

(56) References Cited

U.S. PATENT DOCUMENTS 3,629,021 A * 12/1971 Lyerly ..... 149/50
4,055,247 A * 10/1977 Benedick et al. ..... 206/3
5,024,159 A * 6/1991 Walley ..... 102/289

(Continued)

FOREIGN PATENT DOCUMENTS

JP 7-208899 1/1994

(Continued)

OTHER PUBLICATIONS

International Search Report of PCT/JP2005/005121 mailed Apr. 26, 2005.

*Primary Examiner*—Bret Hayes
(74) *Attorney, Agent, or Firm*—Reed Smith LLP; Stanley P. Fisher, Esq.; Juan Carlos A. Marquez, Esq.

(57) ABSTRACT

A blasting method of processing a bomb by forming an explosive layer on an outermost surface of the bomb to be processed having a casing in a particular shape and by exploding the explosive layer, wherein the explosive layer comprises a first explosive layer formed around the outermost surface of the casing and a second explosive layer formed as to surround the first explosive layer, an explosive in the second explosive layer has a higher explosion velocity than an explosive in the first explosive layer, and the second and first explosive layers are exploded at a certain time interval by igniting a particular region of the second explosive layer. The method allows low-cost blasting of bombs, by relaxing the impact of the scattering casing fragments.

14 Claims, 11 Drawing Sheets

U.S. PATENT DOCUMENTS 5,149,911 A * 9/1992 Ringbloom et al. ..... 102/302
5,574,203 A 11/1996 Noel et al.
RE36,912 E * 10/2000 Donovan ..... 110/237
6,260,464 B1 * 7/2001 Gorrell et al. ..... 86/50
6,647,851 B2 * 11/2003 Donovan ..... 86/50
2003/0131722 A1 7/2003 Donovan
2003/0209133 A1 * 11/2003 Greenfield et al. ..... 86/50

FOREIGN PATENT DOCUMENTS

JP 2000-74600 9/1998

* cited by examiner

BLASTING METHOD

TECHNICAL FIELD

The present invention relates to a method of blasting a bomb, and in particular to a method of blasting a chemical bomb.

BACKGROUND ART

Military bomb such as shell, bomb, land mine, and naval mine are normally filled with an explosive in a steel casing. In particular, chemical weapons are filled with an explosive as well as a chemical agent hazardous to a human body. Examples of the chemical agents used include, for example, mustard and lewisite hazardous to the body.

Treatment of chemical weapons by blasting has been known as a method of processing and detoxifying such chemical weapons. The treatment by blasting has advantages that it does not demand disassembling operation, allows treatment not only of favorably preserved bombs but also of the bombs that are difficult to disassemble because of aged deterioration and deformation, and that most of the chemical agents therein are decomposed under the ultrahigh temperature and ultrahigh pressure generated by explosion. Such a processing method is disclosed, for example, in Patent Document 1.

The blasting is frequently performed in a tightly sealed vessel, for prevention of leakage of the chemical agents to outside and adverse effects on environment such as noise and vibration of blasting. It is also advantageous to blast a bomb in a tightly sealed vessel under vacuum, keeping a negative pressure in the vessel even after treatment, for more reliable prevention of the outward leakage of the chemical agents.

[Patent Document 1] Japanese Unexamined Patent Application No. No. 7-208899.

However, when a bomb is blasted by the method described in the Patent Document 1, the vessel should be rigid enough to prevent noise and to withstand the impact by explosion. However, solid fragments, for example, from the bomb shell of weapon scatter at a significantly high velocity by explosion and collide to the vessel, often causing damages on the internal wall of the vessel. Accordingly, the vessel should be replaced occasionally, because it is damaged significantly after several treatments. The vessel is larger in size and weight, and thus, is not easy to replace.

Since establishment of the chemical weapons ban treaty, there is an ever-increasing demand for demolition of chemical weapons all over the world. For example, the Japanese Government ratified the chemical weapons ban treaty and has an obligation under the treaty to demolish chemical weapons left in China by the old Japanese Army. According to the "Outline of the Project for the Destruction of Chemical Weapons abandoned by the old Japanese army" issued in October 2002 by the Project Team for Destruction of Abandoned Chemical Weapons, Cabinet Office, there are estimated, approximately 700,000 chemical weapons still abandoned in all areas of China. In designing the processing facility, the report says that a facility should have a processing capacity of 120 bombs per hour, assuming that 700,000 bombs are processed in three years.

Accordingly, for efficient low-cost processing of a number of the abandoned chemical weapons by the blasting described above, there is a strong demand for a method of blasting bombs in a tightly sealed vessel without damage therein that can reduce the labor and time for exchanging the vessel. In addition, there is a strong need for a highly efficient method of processing many weapons at the same time.

DISCLOSURE OF THE INVENTION

An object of the present invention is to provide a method of blasting bombs that can solve the problems described above.

An aspect of the present invention is a method of processing a bomb by forming an explosive layer on an outermost surface of the bomb to be processed having a casing in a particular shape and by exploding the explosive layer. The explosive layer comprises a first explosive layer being formed around the outermost surface of the casing and a second explosive layer being so formed as to surround the first explosive layer. An explosive in the second explosive layer has a higher explosion velocity than an explosive in the first explosive layer, and the second and first explosive layers are exploded at a certain time interval by igniting a particular region of the second explosive layer.

By the method, the second explosive layer explodes first, and the inner first explosive layer explodes then as it is compressed by the high-speed detonation of the second explosive layer. It is thus possible to obtain a strong detonation force, even if an explosive having a lower explosion velocity is used in the first explosive layer. Generally, such low-velocity explosives are cheaper and more easily available and thus, contribute to a reduction in the cost of processing.

It is also possible to direct the scattering velocity of the bomb shell fragment particles inward, because the detonation vector of the first explosive layer heads inward.

Further, the detonation vector of the explosive present inside the casing, which is inherently directed outward, is changed to a detonation vector directed inward or in parallel, as it is driven by the inward detonation vector of the explosion in the first explosive layer. It is thus possible to reduce the velocity of the bomb shell fragments scattering in the diameter direction by explosion and avoid the damage of its vessel, for example, when the bomb is exploded in the vessel.

BEST MODE FOR CARRYING OUT THE INVENTION

Figure 1:
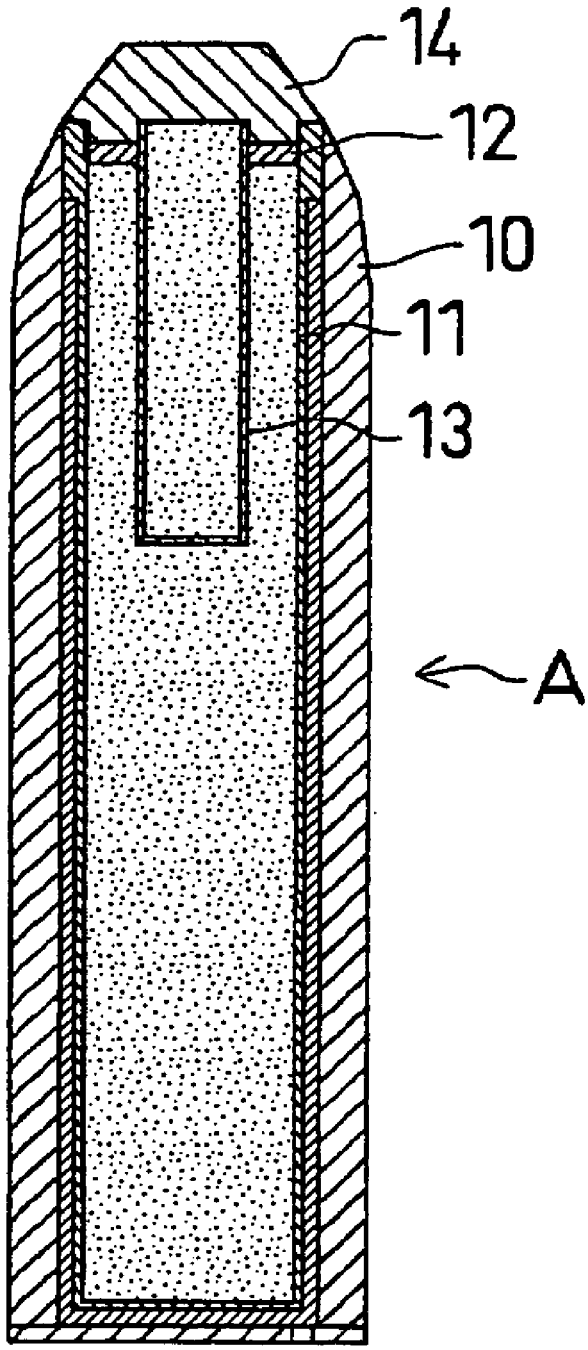
FIG. 1 is a sectional view illustrating the configuration of a 15-kg red bomb, an example of the bomb processed by an embodiment of the processing method according to the present invention.

Hereinafter, favorable embodiments of the present invention will be described. FIG. 1 is a schematic view illustrating the configuration of a 15-kg red bomb A, an example of the chemical weapon, to be processed in the blasting method according to the present invention.

The red bomb A is a chemical weapon containing a red agent such as sneezing or vomiting agent, and most of the chemical weapons the old Japanese army brought into China are said to be red bombs. The red agent is filled in the space between a casing 10 and an internal cylinder 11, and the internal cylinder 11 and the casing 10 are fixed to each other. A brass burster 13 is connected to an internal cap 12 bolted to the internal cylinder 11.

Picric acid is filled inside the burster 13, while a TNT-based explosive (specifically, for example, TNT containing 15% or 20% naphthalene) is filled inside the internal cylinder 11 (outside the burster 13). A cap 14 is bolted to the internal cylinder 11 in the head area.

Hereinafter, the procedure of processing the red bomb A in an embodiment of the blasting method according to the present invention will be described with reference to FIGS. 2A to 5.

Figure 2A:
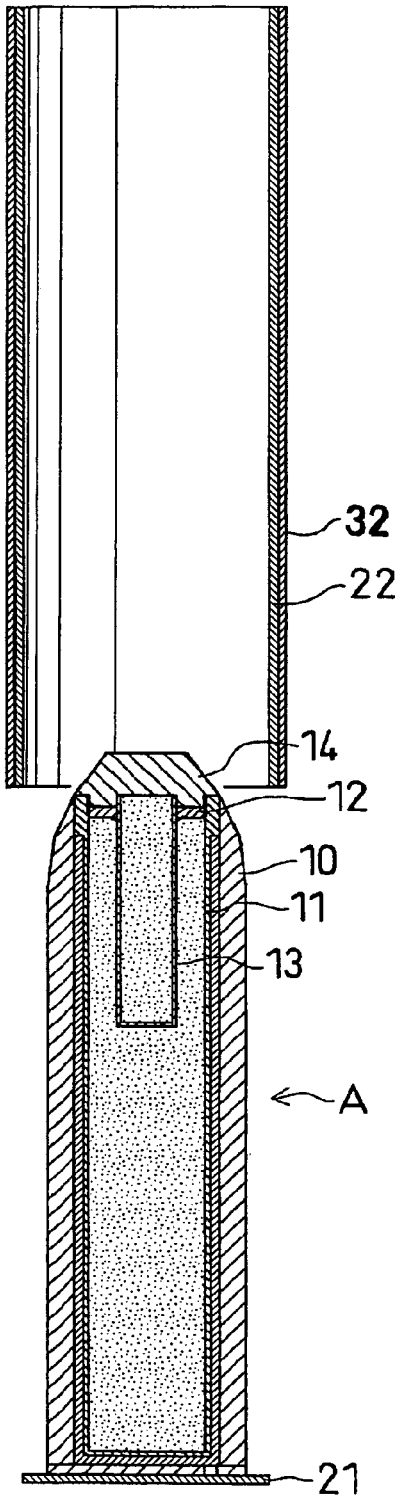
FIG. 2A is a sectional view illustrating a way of covering a red bomb with a cylinder carrying an adhered explosive SEP by the first method of forming an explosive layer.

As shown in FIG. 2A, a red bomb A is placed on and fixed to a bottom plate 21 with its nose facing upward, and the red bomb A is covered with a cylinder 22, for example, of a plastic sheet or paper having openings at both ends.

The outermost surface of the cylinder 22 is wrapped with a sheet-shaped explosive (an explosive SEP in this embodiment). In this manner, a second explosive layer 32 is formed. In covering the bomb, the cylinder 22 is preferably placed at the position with its axis almost identical with that of the red bomb A.

The inner diameter of the cylinder 22 is larger than the outer diameter of the casing 10 of red bomb A, and the height of the cylinder 22 is larger than that of the casing 10 of red bomb A. After enclosure with the cylinder 22, there is a ring-shaped opening g formed between the red bomb A and the cylinder 22 (see FIG. 3A). The bottom plate 21 and the cylinder 22 are tightly connected to each other without any gap, for prevention of leakage of the explosive ANFO described below from the opening g.

Figure 3B:
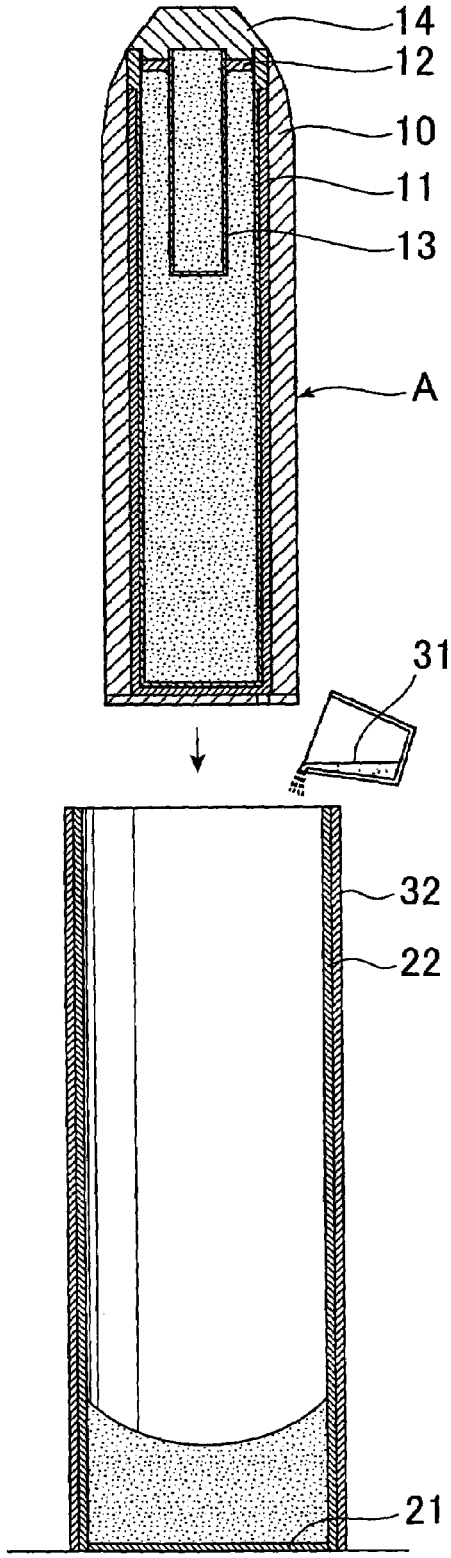
FIG. 3B is a sectional view illustrating a way of infusing an explosive ANFO into a cylinder and pushing a red bomb into the explosive by the second method of forming an explosive layer.
Figure 3A:
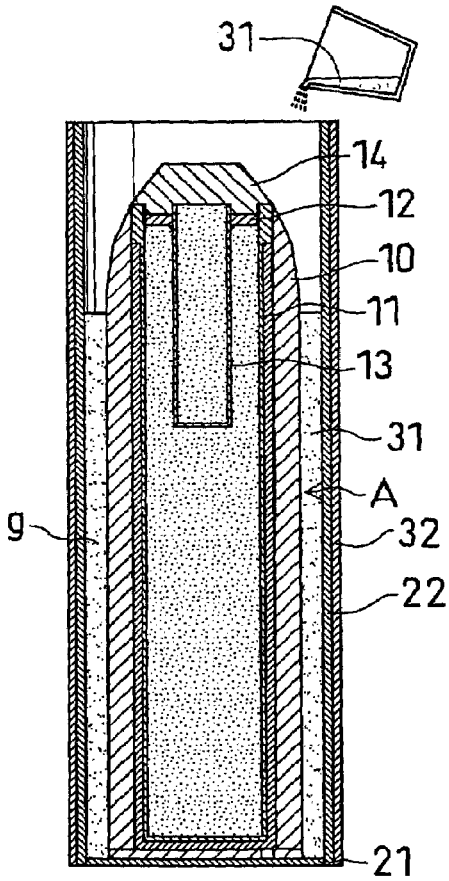
FIG. 3A is a sectional view illustrating a way of filling an explosive ANFO in a space between a red bomb and a cylinder by the first method of forming an explosive layer.
Figure 4:
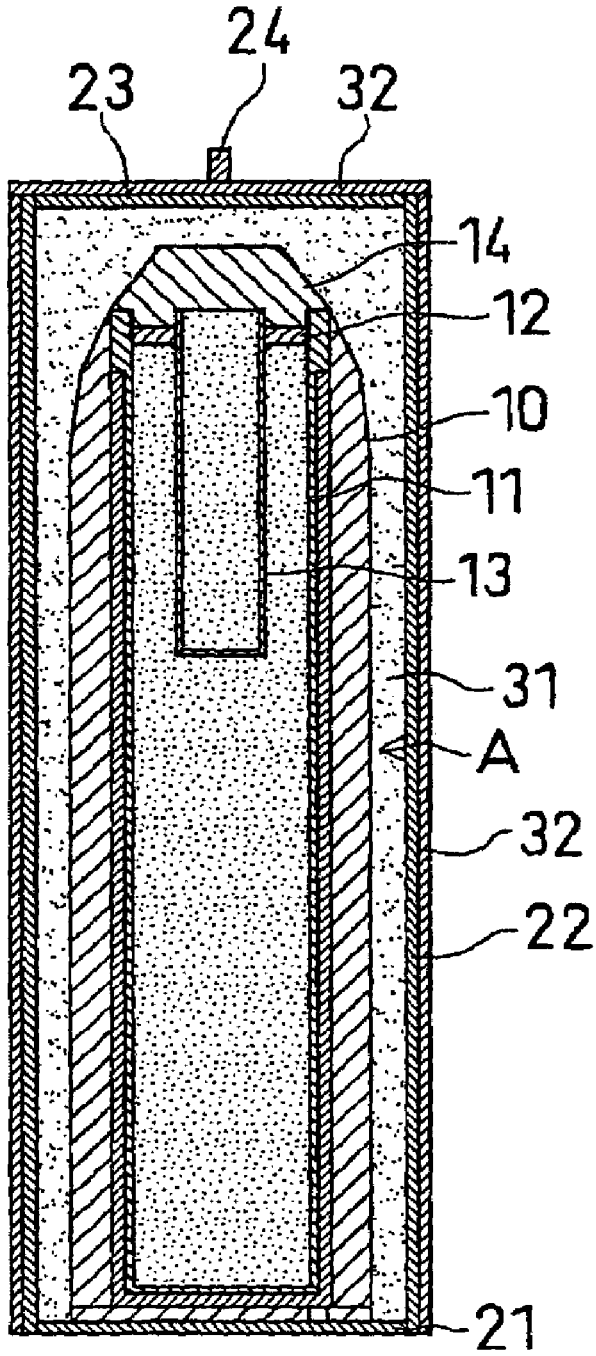
FIG. 4 is a sectional view illustrating a cap plate carrying an adhered explosive SEP being placed on the top end of a cylinder and an exploding bridge wire detonator (EBW detonator) being placed thereon.

Then as shown in FIG. 3A, a granular explosive ANFO is filled into the ring-shaped opening g, forming a first explosive layer 31. After the explosive is filled to the neck of the cylinder 22, as shown in FIG. 4, a cap plate 23, for example of a plastic sheet or paper, is connected to the top end of cylinder 22. A sheet-shaped explosive (explosive SEP) is placed on the top face of the cap plate 23, forming a second explosive layer 32. Finally, an EBW detonator 24 is placed on the center of the cap plate 23.

The explosion velocity of the explosive (explosive SEP) forming the second explosive layer 32 is larger than that of the explosive forming the first explosive layer 31 (explosive ANFO).

Alternatively, a first explosive layer 31 and a second explosive layer 32 may be formed around the red bomb A according to the following method: First, a red bomb A is placed on and fixed to a bottom plate 21 with its nose facing upward, and a cylinder 22 is placed at the position with its axis almost identical with that of the red bomb A. Then, as shown in FIG. 3A, a granular explosive ANFO is filled into the ring-shaped opening g forming a first explosive layer 31, and as shown in FIG. 4, a cap plate 23 is connected to the top end of cylinder 22. A sheet-shaped explosive (for example, explosive SEP) is then adhered to the outermost surface of the cylinder and the top face of the cap plate 23, forming a second explosive layer 32, and finally, an exploding bridge wire detonator (EBW detonator) 24 is connected to the center of the cap plate 23.

Figure 2B:
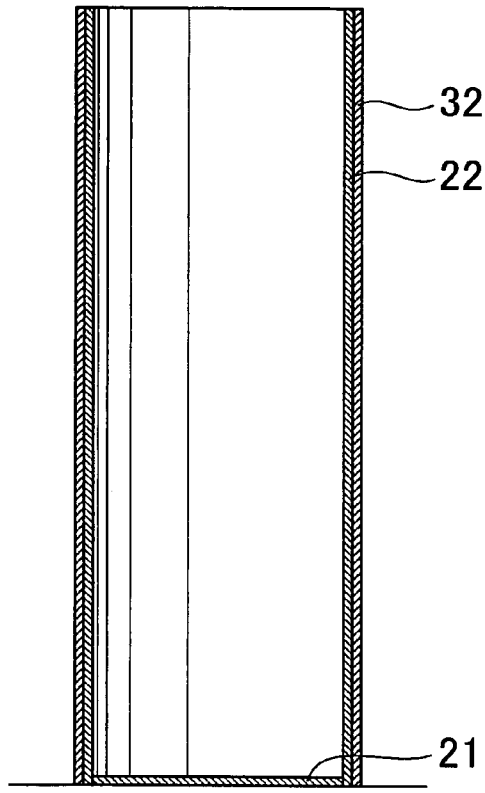
FIG. 2B is a sectional view illustrating a cylinder being placed on a bottom plate by the second method of forming an explosive layer.
Figure 5:
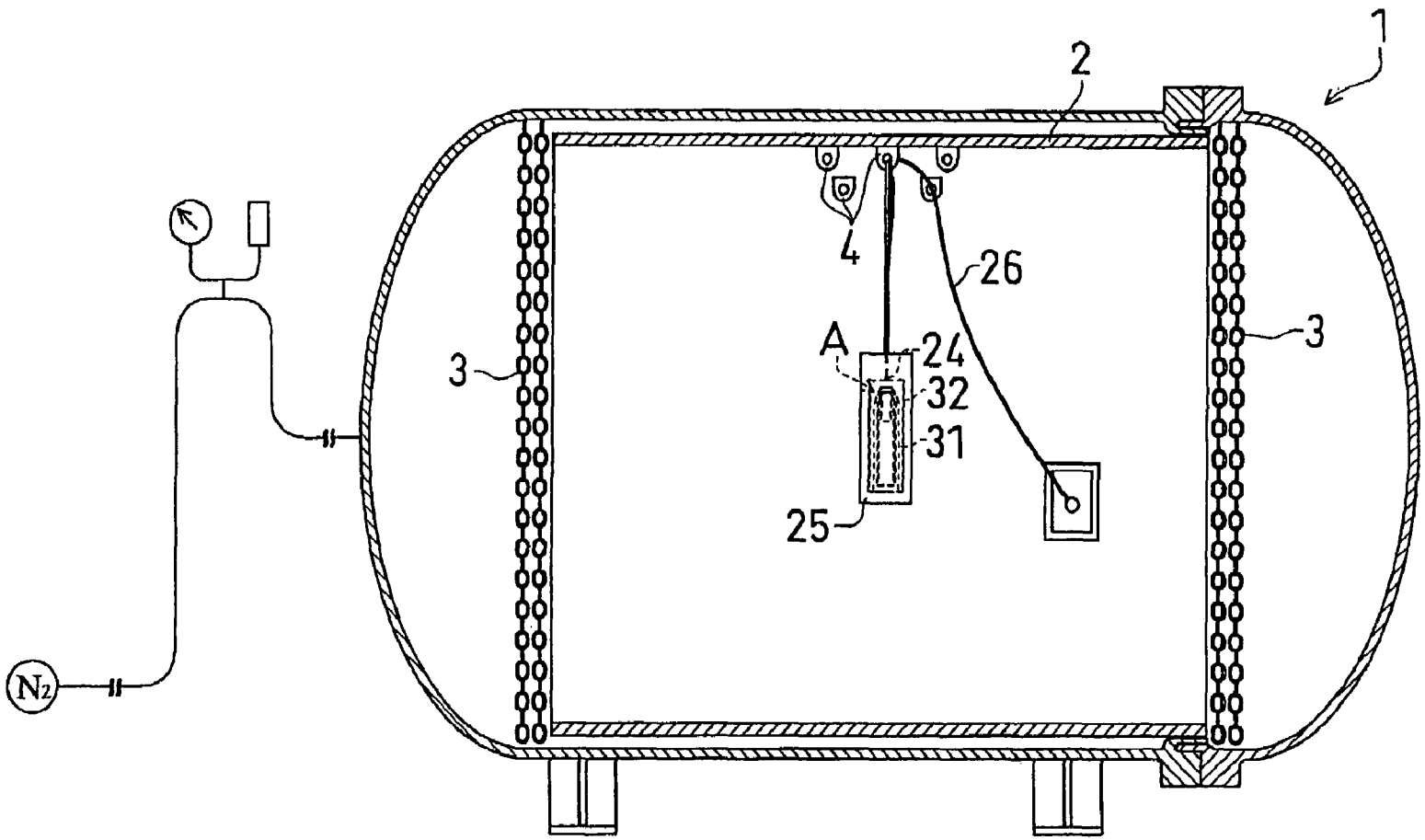
FIG. 5 is a sectional view illustrating a red bomb placed in a pressure vessel.

Yet alternatively, a first explosive layer 31 and a second explosive layer 32 may be formed around the red bomb A, according to the following method: As shown in FIG. 2B, a cylinder 22 is first placed in the upright state on a bottom plate 21. Then, as shown in FIG. 3B, a granular explosive ANFO forming a first explosive layer 31 is added inside the cylinder to a particular amount. The red bomb A is then pushed forward, making the added explosive ANFO surround the peripheral surface of the red bomb A. As shown in FIG. 4, a cap plate 23 is then connected to the top end of the cylinder 22; a sheet-shaped explosive (for example, explosive SEP) is adhered to the outermost surface of the cylinder and the top face of the cap plate 23, forming a second explosive layer 32; and then, an EBW detonator 24 is connected to the center of the cap plate 23. In this method, it is possible to place the explosive ANFO additionally under the base of the red bomb A. Thus, it is possible to blast the bomb more reliably. In such a case, an additional second explosive layer 32 may be formed under the lower surface of the bottom plate 21. It is possible to blast the bomb more reliably. FIG. 5 shows a pressure vessel 1 for use in blasting. The pressure vessel 1 is a steel pressure vessel having an inner diameter of almost 2 meters and a capacity of approximately 7 cubic meters, and contains a high-tension steel protective cylinder 2 inside with its axis extending in the horizontal direction. A number of protective chains 3 are hung in two layers, enclosing the both terminals of the protective cylinder 2 in the axial direction. A hanger fitting 4 is welded to the internal face (ceiling face) of the protective cylinder 2.

As shown in FIGS. 2A to 4, the red bomb A having an adhered explosive ANFO layer 31 and an explosive SEP layer 32 placed in a bag 25 is hung to the hanger fitting 4. The red bomb A is then placed almost in the center of the pressure vessel 1, with its nose (i.e., the EBW detonator 24 side) facing upward. A blasting wire 26 lead out of the EBW detonator 24 is electrically connected to a blasting machine not shown in the Figure, and the bomb is blasted after the pressure vessel 1 is tightly sealed.

As a result, explosion of the explosive SEP layer 32 occurs first in the EBW detonator 24 region, and then, the inner explosive ANFO layer 31 explodes as compressed by the explosion. It is thus possible to obtain a strong detonation force, even by using a cheap and low-explosion-velocity explosive such as the explosive ANFO layer 31. Thus, the present invention provides an effective and low-cost blasting method. Because the detonation vector of the explosive ANFO layer 31 heads inward, the scattering velocity of the fragment particles of the bomb shell (including red bomb casing 10, internal cylinder 11, and cap 14, and others) is also in the inward direction. The detonation force denotes a pressure of the shock wave caused by detonation, and the detonation vector denotes the direction of the shock wave caused by detonation.

The detonation vector of the explosive such as picric acid or TNT inside the casing, which is inherently directed outward, is redirected inward or in parallel (downward) by the inward detonation vector of the explosive ANFO layer 31. Accordingly, it is possible to reduce the velocity of the bomb shell fragments scattering by explosion in the diameter direction and to reduce the damage of the protective cylinder 2 and the protective chain 3. The effect will be described in detail in the simulation experiments below once again.

In the present embodiment, both the explosive ANFO layer 31 and the explosive SEP layer 32 are formed symmetrically with respect to an axis of the red bomb A to be processed, and the initiation point of the explosive SEP layer 32 (EBW detonator 24) is present on the axis. Thus, the detonation propagates also symmetrically around the axis, making the compression of the explosive ANFO layer 31 by the explosive SEP layer 32 larger and giving a greater detonation force on the explosive ANFO layer 31.

In the present embodiment, it is also possible to make the explosive ANFO layer 31 and the explosive SEP layer 32 surround the periphery of the red bomb A easily, by covering the red bomb A with a cylinder 22 having an explosive SEP layer 32 and placing a granular explosive ANFO layer 31 between the cylinder 22 and the red bomb A. Accordingly, it is possible to simplify the step of blasting.

For verification of the advantageous effects of the blasting method, performed were the following experiments.

Experiment 1

A steel pressure vessel 1 having an inner diameter of 1.8 meters, a length of 3.55 meters, a capacity of 7.1 cubic meters, and an designed pressure of 1 MPa was prepared, and a high-tension steel protective cylinder 2 having a thickness of 50 millimeters that endures a pressure of 580 MPa and a number of protective chains 3 in the two-layered curtain shape were placed inside it for protection from the scattering fragments.

Figure 6:
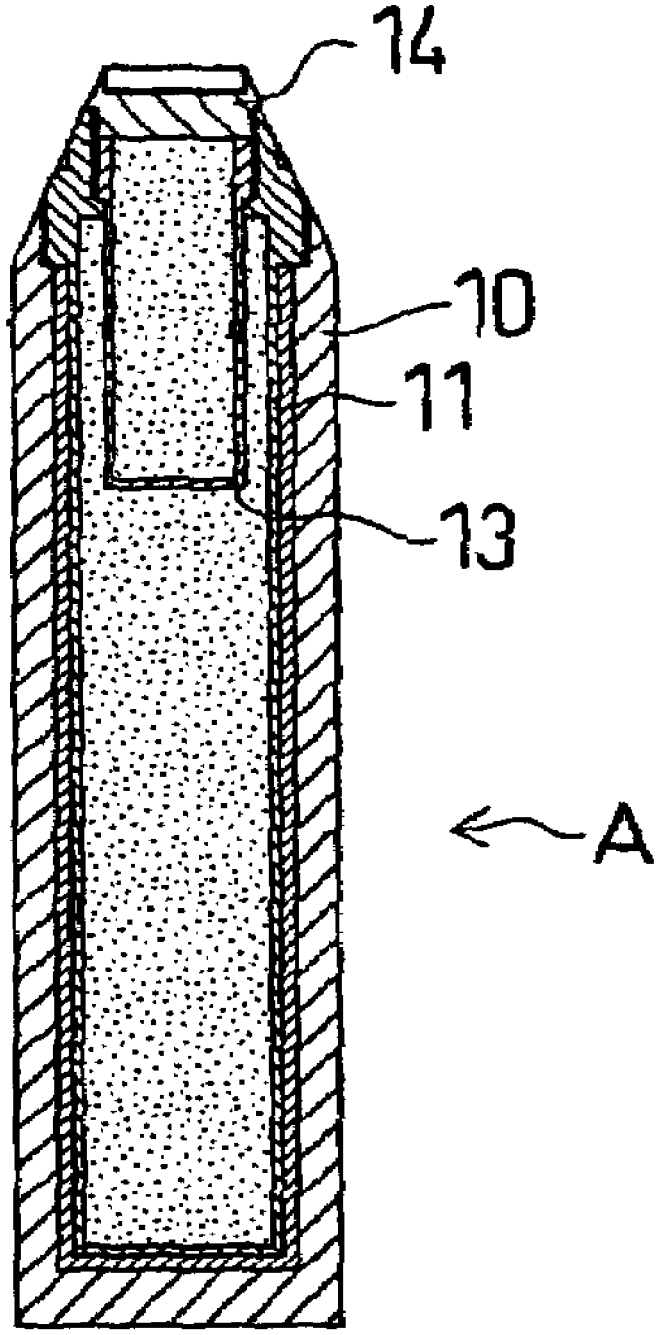
FIG. 6 is a sectional view illustrating the configuration of a red bomb having a diameter of 75 millimeters.

Then, a simulator bomb having a diameter of 75 millimeters and resembling a red bomb was prepared. As shown in FIG. 6, the red simulator bomb A is slightly smaller than the 15-kg red simulator bomb (FIG. 1) described above; and as for the dimensions of the main region, the burster 13 had a diameter of 29 millimeters and a height of 80 millimeters; the internal cylinder 11 had a diameter-of 44 millimeters and a height of 295 millimeters; and the casing 10 had a diameter of 74 millimeters and a height of 302.5 millimeters. As for the red simulator bomb A, all of the casing 10, internal cylinder 11, internal cap 12, burster 13, and cap 14 were made of SS400 steel. 252 grams of an explosive TNT was filled in the internal cylinder 11 and burster 13 of red simulator bomb A. 96.8 grams of a simulant (octanol) for the red agent was filled in the space between the internal cylinder 11 and the casing 10 of red simulator bomb A.

A first explosive (explosive ANFO) layer 31 having a thickness of approximately 10 millimeters was formed uniformly on the external surface of the simulator bomb A according to a method similar to those shown in FIGS. 2A to 4, and in addition, a second explosive (explosive SEP) layer 32 having a thickness of 5 millimeters was formed on the external and top faces thereof. The amounts of the explosives used were 815 grams of an explosive ANFO and 733 grams of an explosive SEP. An EBW detonator 24 was connected to the center of the explosive SEP layer 32 on the top face, and as shown in FIG. 5, the entire bomb was placed in a bag 25 and hung to the hanger fitting 4 in the center of a pressure vessel 1, and the bomb was blasted in the pressure vessel 1 after it was tightly sealed and evacuated.

Visual observation of the internal surface of the protective cylinder 2 after explosion revealed presence of the dents due to hit of the bomb shell fragments on the side wall. However, the depth of the dents was shallow. There were also dents on the bottom face side of the protective cylinder 2 and the depth thereof was rather shallower, although it is deeper than the dents on the side wall. There was no severe damage such as through-hole in the protective cylinder 2 at all.

Thus, the 580 MPa-grade high-strength steel plate having a thickness of 50 millimeters used in the experiment seems to endure repeated blasting more than a conventional plate, and allows a decrease in the frequency of exchange.

After explosion, air was supplied until the pressure in the vessel reaches atmospheric pressure; six liters of air therein was collected as a gas sample; and octanol, a simulant, in the gas sample was collected with silica gel and analyzed by GC/FID after removal of the solvent. There was no octanol detected due to a concentration below the detectable lower limit amount (1.7 milligram/liter).

In addition, after explosion, part of the internal surface of the protective cylinder 2 was washed with eight liters of water, giving a water sample; and the residual amount of the octanol filled in the simulator bomb was determined. The amount of the residual octanol was determined by analysis by GC/FID after removal of the solvent from the water sample. The residual rate of the simulant, assuming that it is uniformly distributed on the solid surface of the vessel after explosion, was determined to be 0.033 percent. These results indicate that most of the chemical agent is decomposed under the ultrahigh temperature and ultrahigh pressure by explosion.

Experiment 2

A simulator bomb resembling the "15-kg red bomb" shown in FIG. 1 that was larger than the red bomb having a diameter of 75 millimeters used in experiment 1 was prepared. As for the main dimensions of the red bomb A, the burster 13 had a diameter of 30 millimeters and a height of 123 millimeters; the internal cylinder 11 had a diameter of 64 millimeters and a height of 350 millimeters; and the casing 10 had a diameter of 100 millimeters and a height of 380 millimeters.

An explosive TNT was filled both inside the burster 13 and the internal cylinder 11 of red simulator bomb A. The amount of the explosive TNT filled was 667 grams. 293.6 grams of a simulant (octanol) for the red agent was filled in the space between the internal cylinder 11 and the casing 10 of red simulator bomb A.

In a similar manner to experiment 1, a first explosive layer 31, i.e., an explosive ANFO layer, was formed on the external surface of the simulator bomb A to a thickness of approximately 10 millimeters, and in addition, a second explosive (explosive SEP) layer 32 having a thickness of 5 millimeters, i.e., a sheet explosive (explosive SEP) layer was formed on the external and top faces thereof. The amounts of the explosives used were 1,379 grams of an explosive ANFO and 1,099 grams of an explosive SEP. In a similar manner to experiment 1, an EBW detonator 24 was connected to the center of the explosive SEP layer 32 on the top face; the entire bomb was placed in a bag 25 and hung to the hanger fitting 4 in the center of a pressure vessel 1; and the bomb was blasted in the pressure vessel 1 after it is tightly sealed and evacuated.

Visual observation of the internal surface of the protective cylinder 2 after explosion revealed presence of the dents due to collision of the bomb shell fragments on the side wall. However, the depth of the dents was very shallow. There were also dents observed on the bottom face side of the protective cylinder 2; the depth thereof was rather deeper than that of the dents on the side wall; and the edge of the dents was more distinct than that of the dents on the bottom face side in experiment 1 (indicating high-speed hit of fragments). However, the dents were rather shallow. In addition, there was no severe damage such as through-hole in the protective cylinder 2 at all.

The amount of the residual simulant octanol was measured in a similar manner to experiment 1, but there was no octanol detected in the gas sample. The residual rate thereof, as calculated from the water sample, was 0.156 percent.

Experiment 3

Separately, an experiment for simulating the detonation propagation when the 15-kg red simulator bomb is blasted by using an EBW detonator 24 was performed by using a computer. The results are summarized in FIG. 7.

The detonation velocity of the explosive was calculated, by assuming that the detonation velocity of explosive TNT is 4.23 kilometer/second; that of explosive SEP, 6.15 kilometer/second; and that of explosive ANFO, 3.00 kilometer/second. It was also assumed that the shock wave velocity propagating in SS400 steel was 5 kilometer/second and the detonation started when the shock wave reached the explosive surface. The shock wave velocity in the simulant was not considered particularly, and assumed to be the same as that in SS400 steel. In addition, in the simulation model for calculation, the cylinder 22 and the cap plate 23 were omitted.

Figure 7:
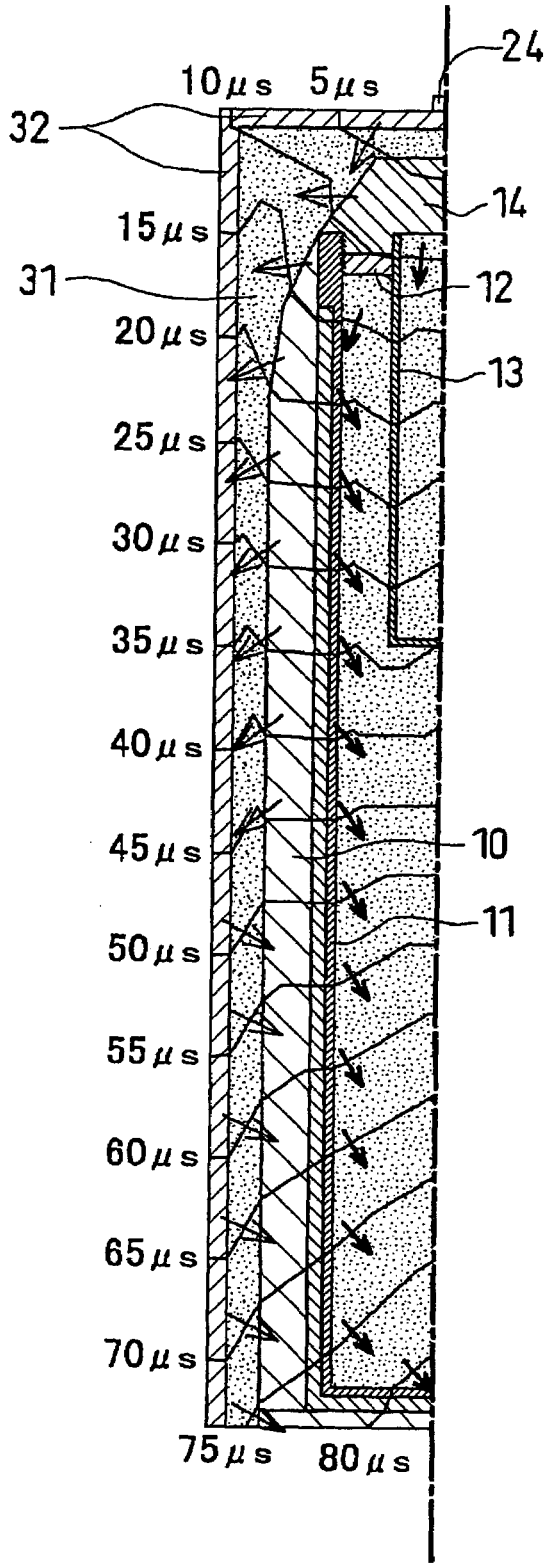
FIG. 7 is a sectional view showing the results of a detonation propagation simulation experiment.

The calculation results are shown as a semi-sectional view in FIG. 7. According to the results shown in FIG. 7, the detonation process from ignition by the EBW detonator 24 to completion of propagation of the detonation wave proceeded over a period of approximately 75 μseconds. In the initial process, explosives SEP, ANFO, and TNT are blasted in that order.

Noteworthy is the direction of the detonation wave in the explosive ANFO layer 31. The direction of the detonation wave in explosive ANFO layer 31 at the interface with the casing 10 (SS400 steel) is outward in the initial phase, but the direction of the detonation wave changes to inward over time or along progress of detonation, as it is driven by the high-detonation velocity (detonation vector) of the explosive SEP layer 32, after 50 μseconds. Thus, the scattering velocity of the bomb shell fragment particles also heads inward after 50 μseconds. The result seems to be the reason for a decrease in the outward velocity of the bomb shell fragments and the reduction of the damage on the protective cylinder 2.

In addition, the explosive TNT initiates detonation approximately 8 μseconds after initiation of blasting, by the shock wave propagating in the SS400 steel cap 14, and the detonation wave propagates in the direction from top to bottom. However, after 15 μseconds, the direction of detonation wave gradually changes inward, as it is driven by the high shock-wave velocity in the SS400 steel internal cylinder 11. The phenomenon also seems to be effective in reducing the bomb shell fragment velocity heading outward.

Figure 8:
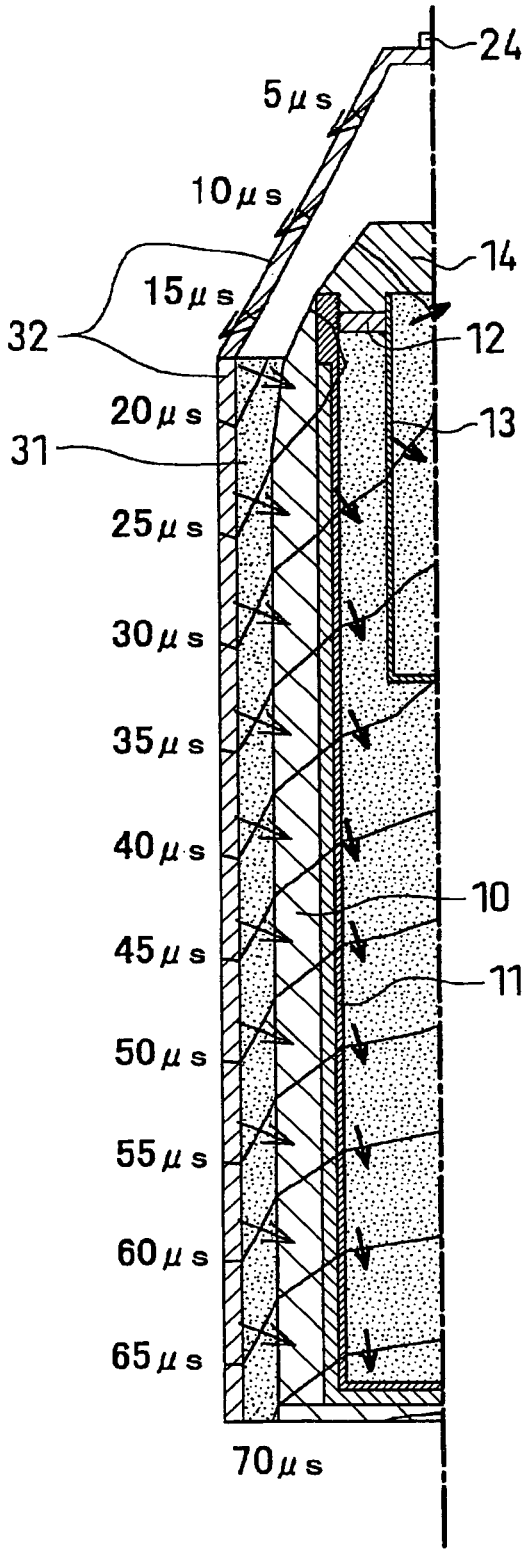
FIG. 8 is a sectional view showing the results of another detonation propagation simulation experiment performed in a model different from that in FIG. 7.

A comparative experiment was performed under a condition similar to the Experiment above, by using another simulation model (FIG. 8) different from that above. The simulation model shown in FIG. 8 is characteristic in two points: One is that there is a space lacking the explosive ANFO layer 31 between the nose of the red bomb A (cap 14) and the EBW detonator 24; and the other is that the explosive SEP layer 32 covering the nose of the simulator bomb A is formed in the conic shape.

In the model, the explosive SEP layer 32 (conic region) first initiates detonation by initiation of blasting by the EBW detonator 24, but propagation of the detonation wave directly to the cap 14 is prohibited by the space. Thus, the detonation wave propagates from the EBW detonator 24 to the explosive ANFO layer 31 by a roundabout way from outside. Different from the results shown in FIG. 7, the detonation vector in the explosive ANFO layer 31 is already heading inward from the initial phase (after approximately 20 μseconds) in the simulation experiment. Thus, by placing a space between the EBW detonator 24 and the nose as in the model shown in FIG. 8, it is obviously possible to direct the scattering velocity of bomb shell fragment particles inward, more reliably than in the model shown in FIG. 7.

It is also possible to place a first explosive layer 31-forming explosive ANFO 31 below the red bomb A and a second explosive layer 32-forming explosive SEP on the bottom face of the explosive ANFO 31. In such a case, the explosive ANFO layer 31 in the lower red bomb A is connected to the explosive ANFO layer 31 on the external surface of the red bomb A; and the explosive SEP layer 32 in the lower red bomb A is connected to the explosive SEP layer 32 cylindrically covering the outside of the red bomb A and explosive ANFO layer 31. In other words, the first and second explosive layers surrounding the external surface of the red bomb A are extended to the bottom face of the red bomb A (tail side). In this manner, it is possible to reduce the downward particle velocity of the bomb shell fragments.

Figure 9:
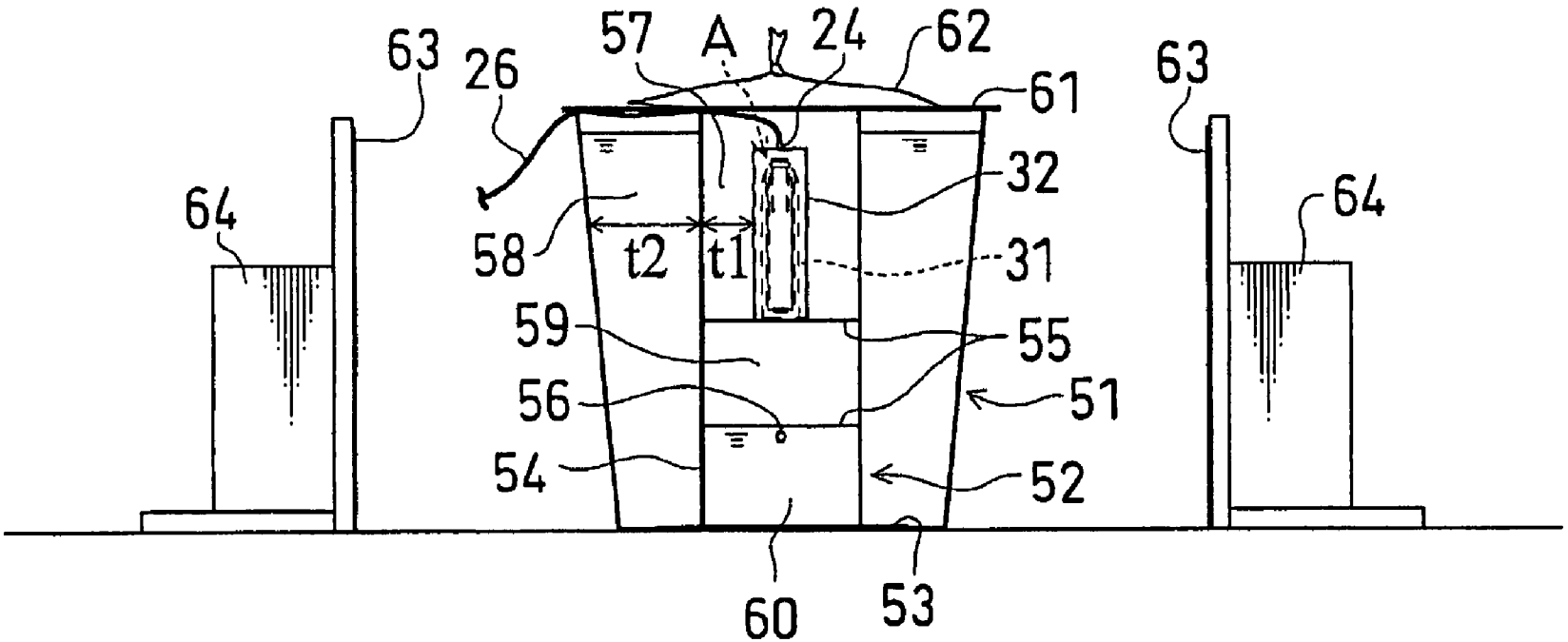
FIG. 9 is a sectional view illustrating a method of blasting a red bomb while it is surrounded by a water wall.

In the embodiment described above, described is a method of blasting a bomb inside a steel pressure vessel, but the present invention is not limited to such a case. The bomb to be processed may be blasted in an open space, if it is less toxic or nontoxic. Alternatively, it may be blasted in a sealed space surrounded by walls of a water-filled member. Specifically, as shown in FIG. 9, the bomb to be processed is placed in a polyvinyl chloride bucket-shaped vessel 51 filled with water, as it is enclosed in a polyvinyl chloride jig 52 immersed therein. The jig 52 is a pipe 54 formed on the bottom plate 53, and the pipe 54 inside is divided by two partition plates 55 into three compartments, top, intermediate and bottom.

Among the three compartments in the pipe 54, the top compartment contains the bomb to be processed inside. In the region of the bottom compartment, a communicating hole 56 is formed in the pipe 54, allowing the jig 52 to be immersed in water in the vessel 51 and water in the bucket-shaped vessel 51 to flow into the bottom compartment in the pipe 54 through the communicating hole 56. The lower partition plate 55 is tightly connected to the internal surface of the pipe 54, prohibiting flow of the water in the bottom compartment into the middle and top compartments.

The inner diameter of the pipe 54 is slightly larger than the outer diameter of the bomb to be processed, and there is a ring-shaped space 57 formed between the bomb to be processed and the internal surface of pipe 54. There is a space 59 formed between the bottom of the bomb to be processed and the water wall 60 of the jig 52. On the other hand, a plywood board 61 is placed above the bomb to be processed as it encloses the top end of the pipe 54 and a water bag 62 is placed thereon, forming a bomb-blasting space that are sealed with water walls filled with water. Then, an experiment was performed by using this vessel.

Experiment 4

In this experiment, the "red simulator bomb having a diameter of 75 millimeters" used in experiment 1 above was placed in the tightly seated space. The kinds and amounts of the explosives used were the same as those in experiment 1.

The distance t1 between the outermost surface of red simulator bomb A and the internal face of pipe 54 was 107 millimeters; the average thickness t2 of the water wall region 58 formed between the pipe 54 and the bucket-shaped vessel 51 in the diameter direction was 280 millimeters; the thickness of the space 59 in the axial direction was 200 millimeters; the thickness of the water wall region 60 under pipe 54 in the axial direction was 200 millimeters; the thickness of the plywood 61 placed on the top edge of the pipe 54 was 10 millimeters; and the thickness of the water bag 62 was approximately 50 millimeters.

For evaluation of the power of the fragments scattering during blasting, a SS400 steel plate 63 (test plate) having a width of 500 millimeters and a length of 800 millimeters was placed upright along a table 64 placed at a position separated from the center by approximately 1 meter. Two test plates 63 were placed, facing each other and holding the vessel 51 inside. The experiment was not performed in the pressure vessel shown in FIG. 5 but in a particular pit for blasting experiment.

After initiation and blasting under the condition above, the appearance of the test plates 63 was observed visually, showing that there was no damage at all on the two plates that was seemingly caused by the bomb shell fragments. The appearance of the internal surface of the bucket-shaped vessel 51 was also observed, showing that there were many scratches seemingly due to the scattering fragments but there was no damage penetrating the vessel 51. The results indicate that the power of the fragments scattering by explosion is weakened by the water wall regions 58 and 60 and the fragments reached the internal surface of the bucket-shaped vessel 51 but did not penetrate it.

A comparative experiment 1 was performed under a condition similar to that of the experiment above, except that the bucket-shaped vessel 51 was replaced with a slightly smaller bucket-shaped vessel (not shown in Figure), and the average thickness of the water wall region 58 surrounding the red simulator bomb A in the diameter direction was 162 millimeters. As a result, there were two through-holes in the test plates 63. There were also many penetrating damages in the smaller bucket-shaped vessel.

Separately, in another comparative experiment 2, a red simulator bomb A was blasted as it was immersed directly in water without use of the jig 52. In other words, the experiment was performed without the spaces 57 and 59. The average thickness of the water wall region surrounding the red simulator bomb A was calculated to be 269 millimeters. After the experiment, the test plates 63 were completely free from damage and there was also no damage seemingly caused by bomb shell fragments on the internal surface of the bucket-shaped vessel 51.

It is apparent from the results above that it is possible to reduce the power of the bomb shell fragments scattering during explosion effectively, by increasing the thickness t2 of the water wall region 58 in the diameter direction to at least approximately 250 millimeters or more.

Favorable embodiments of the present invention were described above, but the present invention is not limited to the methods in the embodiments above, and, for example, may be modified in the following manners:

1The explosive used in the first explosive layer is not limited to the granular explosive ANFO. An emulsified (fluidal) explosive may be used in the first explosive layer. In such a case, it is possible to form a first explosive layer surrounding bomb to be processed in a simple operation, by filling the emulsified explosive inside the cylinder 22 and then immersing the bomb to be processed in the infused emulsified explosive.

(2) The explosive in the second explosive layer is not limited to the explosive SEP. For example, RDX-based, PETN-based, and other explosives may be used. In short, the explosive is arbitrary, as far as it has an detonation velocity higher than that of the first explosive layer.

Figure 10:
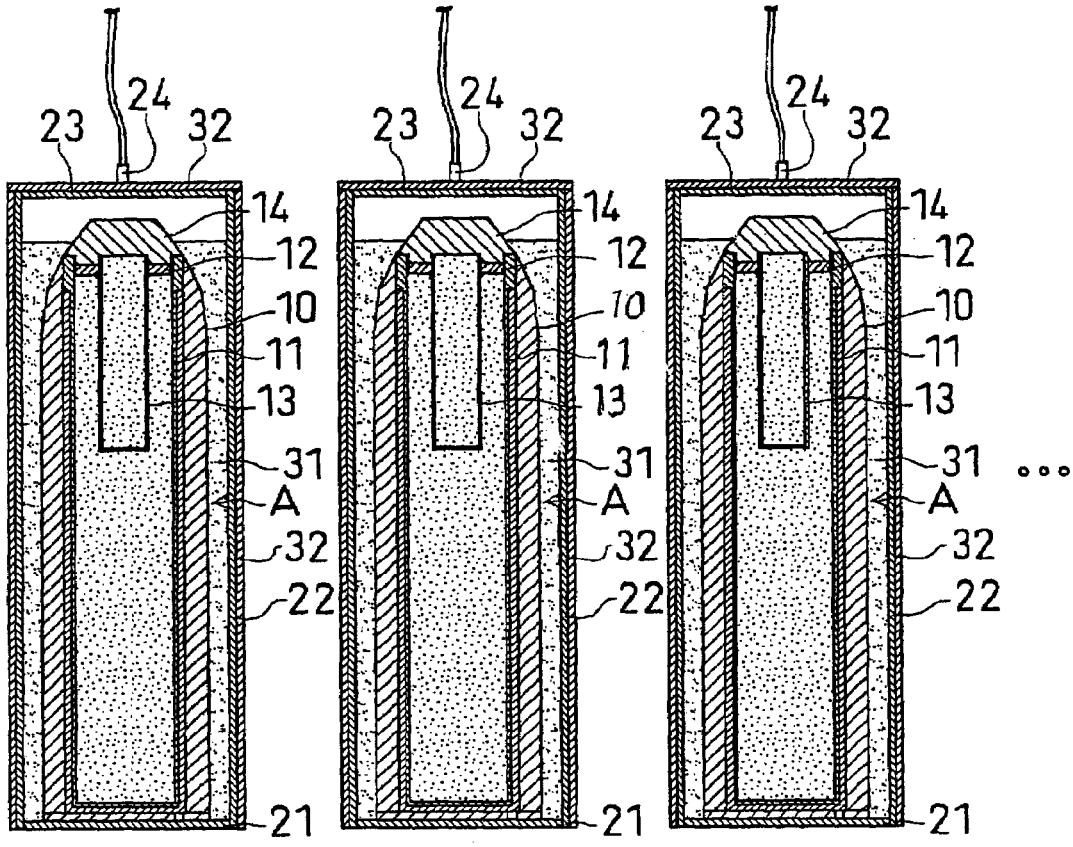
FIG. 10 is a sectional view illustrating a method of processing multiple red bombs placed in parallel at the same time.

(3) The present invention is not limited to the case where only one bomb is processed at a time. Multiple bombs A may be processed at a time, for example by placing, in parallel, the multiple bombs to be processed A having the first and second explosive layers and applying power to the respective EBW detonators 24 at the same time, as shown in FIG. 10.

Figure 11:
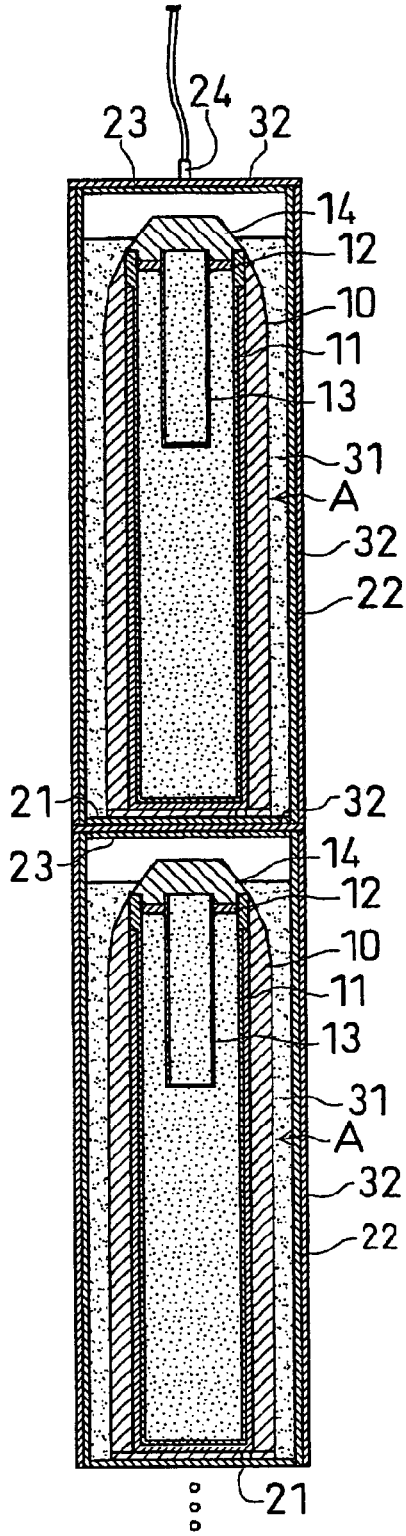
FIG. 11 is a sectional view illustrating a method of processing multiple red bombs as they are piled.

(4) Alternatively, multiple bombs A may be processed at a time, by piling multiple bombs to be processed A one on another and blasting them consecutively by applying power to the EBW detonator 24 of the top bomb A to be processed, as shown in FIG. 11. In these ways, it is possible to process multiple bombs A at a time and improve the processing efficiency drastically. In addition, the particle velocity of the bomb shell fragments of the bomb to be processed A heads inward in both cases, and thus, it is possible to reduce or eliminate the damage of the vessel even when multiple bombs are blasted in a vessel. Alternatively, four bombs A, two bombs in the horizontal direction and two bombs in the vertical direction, may be processed at the same time.

(5) The processing method according to the present invention is not limited to the processing of the red bomb above, and applicable to other chemical weapons such as yellow bomb. It is also applicable to processing of high explosive bombs and ammunition.

As described above, the new blasting method is a method of processing a bomb by forming an explosive layer on an outermost surface of the bomb to be processed having a casing in a particular shape and by exploding the explosive layer, wherein the explosive layer comprises a first explosive layer formed around the outermost surface of the casing and a second explosive layer formed as to surround the first explosive layer, an explosive in the second explosive layer has a higher explosion velocity than an explosive in the first explosive layer, and the second and first explosive layers are exploded at a certain time interval by igniting a particular region of the second explosive layer.

In the method, the second explosive layer explodes first, and the inner first explosive layer explodes then as it is compressed by the high-speed detonation of the second explosive layer. Thus, it is possible to obtain a strong detonation force, even when an explosive having a low explosion velocity is used in the first explosive layer. It is also possible to direct the scattering velocity of the bomb shell fragment particles inward, because the detonation vector of the first explosive layer heads inward. Further, the detonation vector of the explosive present inside the casing, which is inherently directed outward, is changed to a detonation vector directed inward or in parallel, as it is driven by the inward detonation vector of the explosion in the first explosive layer. Thus, it is possible to reduce the velocity of the bomb shell fragments scattering in the diameter direction by explosion and avoid the damage of its vessel, for example, when the bomb is exploded in the vessel.

When the casing is cylindrical in shape, it is preferable to place the first and second explosive layers symmetrically with respect to an axis of the casing and form an ignition region at an intersection of the axis of the casing with the second explosive layer.

It is possible to obtain stronger detonation force when the explosives are placed symmetrically to the axis, because the detonation also propagates symmetrically to the axis and the first explosive is compressed more intensely by detonation of the second explosive.

It is also possible to place the ignition region on top of the second explosive layer and to eliminate the first explosive layer from a space between the ignition region and a top region of the casing.

It is thus possible to direct the scattering velocity of the bomb shell fragment particles of the bomb to be processed inward more reliably. Accordingly, it is possible to further reduce the particle velocity of the bomb shell fragment.

The first explosive layer is preferably formed with an explosive ANFO. The explosive ANFO is cheaper, and it is possible to process chemical bombs at lower cost by using this explosive.

The first explosive layer is preferably formed with an explosive having a desirable flowability. The desirable flowability is a flowability to the degree allowing easier infusion of the explosive into the cylinder and easier pushing of the bomb to be processed into the explosive. In this way, it is possible to form the first explosive layer easily at low cost. It is also possible to blast the bomb efficiently.

The explosive layer is preferably formed by (1) placing a cylindrical bomb to be processed upright on a bottom plate in a particular shape, (2) covering the cylindrical bomb to be processed with a cylinder having an inner diameter larger by a particular length than an outer diameter of the cylindrical bomb to be processed and a height larger by a particular length than a height of the cylindrical bomb to be processed, (3) filling an explosive having a desirable flowability in a space between the cylinder and the cylindrical bomb to be processed, and (4) covering the cylindrical bomb to be processed by placing a cap plate on top of the cylinder and forming a second explosive layer on the outermost surface of the cylinder and the cap plate, and placing a detonator on the cap plate.

Alternatively, the explosive layer may be formed by (1) placing a cylindrical bomb to be processed upright on a bottom plate in a particular shape, (2) covering the cylindrical bomb to be processed with a cylinder carrying a second explosive layer formed previously on the peripheral surface, the cylinder having an inner diameter larger by a particular length than an outer diameter of the cylindrical bomb to be processed and a height larger by a particular length than a height of the cylindrical bomb to be processed, (3) filling an explosive having a desirable flowability in a space between the cylinder and the cylindrical bomb to be processed, and (4) covering the cylindrical bomb to be processed by placing a cap plate having a previously formed detonator and a second explosive layer on top of the cylinder.

Yet alternatively, the explosive layer may be formed by (1) placing a cylinder upright on a bottom plate in a particular shape, the cylinder having an inner diameter larger by a particular length than an outer diameter of the cylindrical bomb to be processed and a height larger by a particular length than a height of the cylindrical bomb to be processed, (2) infusing inside of the cylinder with an explosive having a desirable flowability for forming a first explosive layer in a particular amount, (3) pushing the cylindrical bomb to be processed into the explosive infused in the cylinder, (4) covering the cylindrical bomb to be processed by placing a cap plate on top of the cylinder and (5) forming a second explosive layer on the outermost surface of the cylinder and the cap plate, and placing a detonator on the cap plate.

It is possible to form explosive layers easily by these methods of forming explosive layers. It is thus possible to make the blasting simpler and provide a blasting method superior in processing efficiency.

Two or more of the bombs to be processed having the explosive layers may be processed as they are placed side by side and ignited simultaneously. Alternatively, two or more of the bombs to be processed having the explosive layers may be processed as they are piled and a particular region of the bomb to be processed being located at the top is ignited. In this way, it is possible to process multiple chemical bombs at a time and thus, to provide a blasting method superior in processing efficiency.

The bomb to be processed, which contains a chemical agent hazardous to the body inside the casing, is preferably blasted in a tightly sealed vessel. By processing in a tightly sealed vessel, it is possible to prevent leakage of toxic chemical agent, if partly remaining after blasting, directly into air.

The walls of the tightly sealed vessel may be formed by filling them with a fluid such as water. It is thus possible to weaken the power of the bomb shell fragment scattering by blasting, with the walls formed of the fluid such as water. Accordingly, it is possible to avoid the damage of the vessel, for example, when the bomb is exploded in the vessel.

The thickness of the walls formed of the fluid is preferably 250 millimeters or more. It is possible in this way to weaken the power of the bomb shell fragments scattering by blasting more effectively.

INDUSTRIAL APPLICABILITY

The present invention relates to a method extremely useful for elimination of chemical weapons, the philosophical basis of the chemical weapons ban treaty. It has an industrial advantage that it is possible to process abandoned chemical weapons at low cost.

The invention claimed is:

1. A blasting method of processing at least one bomb to be processed, comprising:

forming an explosive layer on an outermost surface of the bomb to be processed having a casing; and exploding the explosive layer, wherein the explosive layer comprises a first explosive layer formed around the outermost surface of the casing and a second explosive layer formed as to surround the first explosive layer, an explosive in the second explosive layer has a higher explosion velocity than an explosive in the first explosive layer, and the second explosive layer is exploded first and then the first explosive layer is exploded after passing a certain time interval by igniting an ignition region of the second explosive layer.

2. The blasting method according to claim 1, wherein the casing is cylindrical in shape; the first and second explosive layers are placed symmetrically with respect to an axis of the casing; and the ignition region is placed at an intersection of the axis of the casing with the second explosive layer.

3. The blasting method according to claim 2, wherein the ignition region is placed on top of the second explosive layer; and no first explosive layer is formed between the ignition region and a top region of the casing.

4. The blasting method according to claim 3, wherein a conic gap provided between the second explosive layer and the top region of the casing.

5. The blasting method according to claim 1, wherein the first explosive layer is formed with an explosive ANFO.

6. The blasting method according to claim 1, wherein the first explosive layer is formed with an explosive having a desirable flowability.

7. The blasting method according to claim 1, wherein the casing is cylindrical in shape and the explosive layer is formed in the following steps including:

a first step of placing the cylindrical bomb to be processed upright on a bottom plate in a particular shape, a second step of covering the cylindrical bomb to be processed with a cylinder having an inner diameter larger by a particular length than an outer diameter of the cylindrical bomb to be processed and a height larger by a particular length than a height of the cylindrical bomb to be processed, a third step of filling an explosive having a desirable flowability in a space between the cylinder and the cylindrical bomb to be processed, a fourth step of covering the cylindrical bomb to be processed by placing a cap plate on top of the cylinder, and a fifth step of forming a second explosive layer on the outermost surface of the cylinder and the cap plate, and placing a detonator on the cap plate.

8. The blasting method according to claim 1, wherein the casing is cylindrical in shape and the explosive layer is formed in the following steps including:

a first step of placing the cylindrical bomb to be processed upright on a bottom plate in a particular shape, a second step of covering the cylindrical bomb to be processed with a cylinder carrying a second explosive layer formed previously on the peripheral surface, the cylinder having an inner diameter larger by a particular length than an outer diameter of the cylindrical bomb to be processed and a height larger by a particular length than a height of the cylindrical bomb to be processed, a third step of filling an explosive having a desirable flowability in a space between the cylinder and the cylindrical bomb to be processed, and a fourth step of covering the cylindrical bomb to be processed by placing a cap plate having a previously formed detonator and a second explosive layer on top of the cylinder.

9. The blasting method according to claim 1, wherein the casing is cylindrical in shape and the explosive layer is formed in the following steps including:

a first step of placing a cylinder upright on a bottom plate in a particular shape, the cylinder having an inner diameter larger by a particular length than an outer diameter of the cylindrical bomb to be processed and a height larger by a particular length than a height of the cylindrical bomb to be processed, a second step of infusing inside of the cylinder with an explosive having a desirable flowability for forming a first explosive layer in a particular amount, a third step of pushing the cylindrical bomb to be processed into the explosive infused in the cylinder, a fourth step of covering the cylindrical bomb to be processed by placing a cap plate on top of the cylinder, and a fifth step of forming a second explosive layer on the outermost surface of the cylinder and the cap plate, and placing a detonator on the cap plate.

10. The blasting method according to claim 1, wherein two or more of the bombs are to be processed, and the bombs each having the explosive layer are placed in parallel and processed by being ignited at the same time.

11. The blasting method according to claim 1, wherein two or more of the bombs are to be processed, and the bombs each having the explosive layer are piled and processed by being ignited at the ignition region thereof located at the top.

12. The blasting method according to claim 1, wherein the bomb to be processed contains a chemical agent hazardous to a human body inside the easing and is blasted in a tightly sealed vessel.

13. The blasting method according to claim 12, wherein a fluidal substance is filled in a wall of the tightly sealed vessel.

14. The blasting method according to claim 13, wherein the thickness of the wall is 250 millimeters or more.

* * * * *